US005782659A

United States Patent [19]

Motose

[11] Patent Number: 5,782,659

[45] Date of Patent: Jul. 21, 1998

[54] CONTROL FOR WATERCRAFT

[75] Inventor: Hitoshi Motose, Hamamatsu, Japan

[73] Assignee: Sanshin Kogyo Kabushiki Kaisha, Hamamatsu, Japan

[21] Appl. No.: 594,309

[22] Filed: Jan. 30, 1996

[30] Foreign Application Priority Data

Jan. 30, 1995 [JP] Japan ..... 2-012872

[51] Int. Cl.[6] ..... B63H 21/22

[52] U.S. Cl. ..... 440/1; 440/87

[58] Field of Search ..... 440/1, 2, 85, 86, 440/87, 88

[56] References Cited

U.S. PATENT DOCUMENTS 4,822,307 4/1989 Kanno ..... 440/1

4,861,291 8/1989 Koike ..... 440/1

4,938,721 7/1990 Koike ..... 440/87

5,022,370 6/1991 Ferguson et al. ..... 440/1

*Primary Examiner*—Stephen Avila

*Attorney, Agent, or Firm*—Knobbe, Martens, Olson & Bear LLP

[57] ABSTRACT

An improved propulsion unit control system for marine units having at least two propulsion systems. A single lever control controls the speed of both propulsion systems and if a difference in speed occurs, the speed of the faster propulsion unit is reduced. In addition, each propulsion unit includes a respective abnormal condition sensor which outputs a signal to a common control system. This common control system reduces the speed of both propulsion units when an abnormal condition is sensed in either unit.

12 Claims, 3 Drawing Sheets

CONTROL FOR WATERCRAFT

BACKGROUND OF THE INVENTION

This invention relates to a control for watercraft and more particularly to an improved control arrangement for watercraft having multiple propulsion units.

Many forms of watercraft employed dual propulsion systems. For example, watercraft may at times employ either two outboard motors, both mounted on the transom and operating together, or two inboard/outboard drives, which also operate together. With such dual propulsion units, there are some advantages in having a single control for at least the speed function of both propulsion units. In addition to providing more stable performance under normal running conditions, a single control for both throttles of the engines can simplify installation and reduce costs.

However, a situation may arise wherein the single control does not effect the desire of simultaneous movement of the throttle controls of both engines. If this occurs, the watercraft handling and stability may deteriorate.

It is, therefore, a principal object of this invention to provide an improved single control arrangement for a dual marine propulsion system.

It is a further object of this invention to provide a single control arrangement for multiple marine propulsion systems wherein malfunctions in the control apparatus are compensated for in the running of the propulsion units.

There have also been provided with marine propulsion units systems whereby in the event of some abnormal condition in engine operation, the engine is permitted to continue to operate but at a reduced speed. This allows the watercraft and its occupants to safely reach an area where corrections can be made. However by reducing the speed of the engine, it is protected from damage as a result of the abnormal condition.

Where there are provided dual propulsion units and each is provided with such a protection system, a situation may occur where one of the propulsion units is suddenly slowed due to the existence of an abnormal condition with that engine. Again, this can cause difficulties in stability and control. There have been proposed, therefore, systems where the slowing of the speed of one propulsion unit is accompanied by the automatic slowing of speed of the other propulsion unit. Such an arrangement is shown in U.S. Pat. No. 4,708,699, entitled "Warning Device for Watercraft Provided with a Plurality of Marine Propulsion Engines," issued Nov. 24, 1987 and assigned to the assignee hereof.

With the type of system shown in that patent, each propulsion unit is provided with its own individual control system including the abnormality sensor, the control logic, and the mechanism for reducing the engine speed. In addition, a communications circuit must also be provided so that the slow down of speed of one engine will be transmitted to a slow down in the speed of the other engine. This obviously requires duplicative components and additional components which reduce the cost and complexity of the system.

It is, therefore, a still further object of this invention to provide an improved protection system for a dual marine propulsion unit wherein the slowing of one engine automatically is accompanied by the slowing of the other engine but the number of the other components is significantly reduced.

SUMMARY OF THE INVENTION

A first feature of this invention is adapted to be embodied in a marine propulsion system including a pair of propulsion units for powering the same watercraft. A single control is provided for controlling the same function simultaneously of each of the propulsion units. Means are provided for sensing when one of the propulsion units has not responded to the input from the control. In that event, the operation of the other propulsion unit is altered so as to match that of the non-responsive propulsion unit.

A further feature of this invention is adapted to be embodied in an abnormality protection system for a dual marine propulsion unit. Each propulsion unit is provided with an abnormality sensor for sensing an abnormality in that propulsion unit. The outputs from these abnormality sensors are provided to a single control. The single control reduces the speed of both of the propulsion units in the event of the sensing of an abnormality in either unit.

DETAILED DESCRIPTION OF THE PREFERRED EMBODIMENTS OF THE INVENTION

Figure 1:
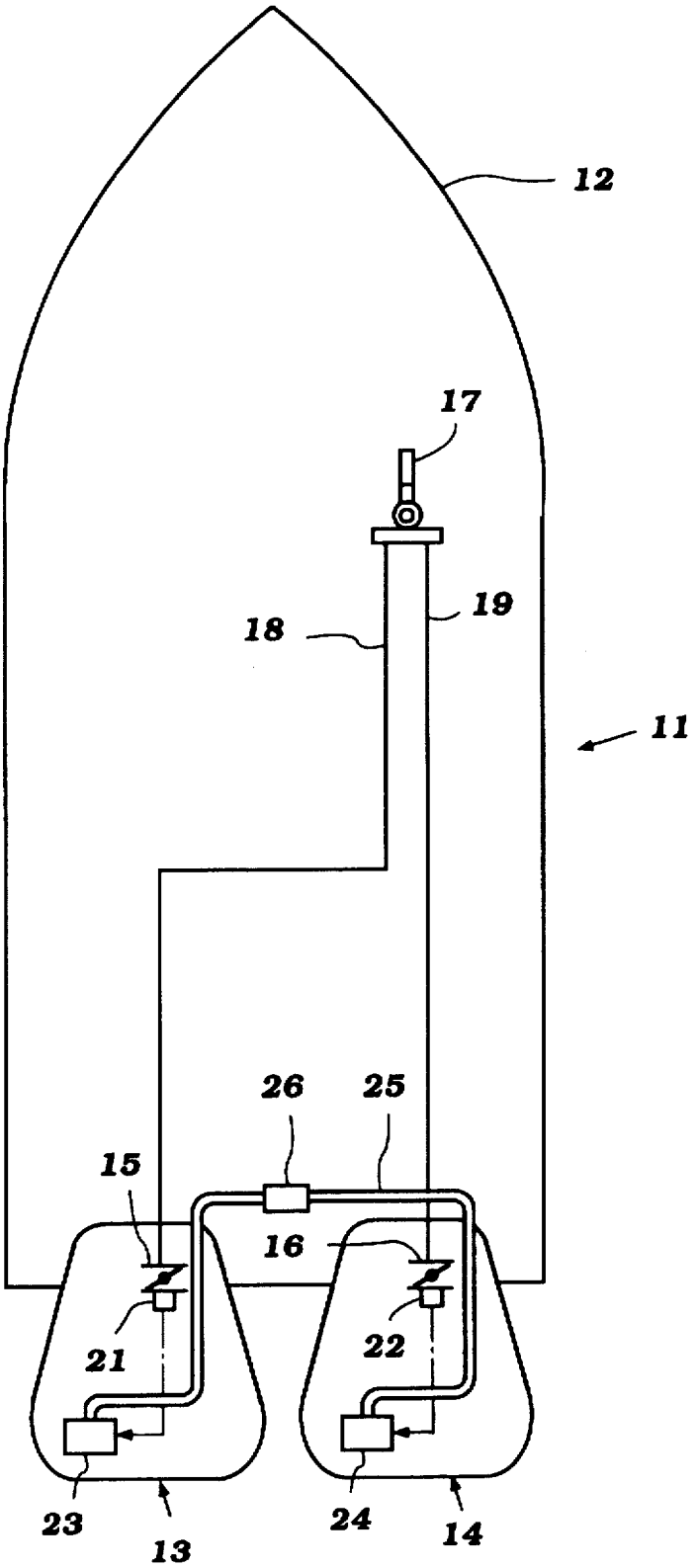
FIG. 1 is a partially schematic top plan view of a watercraft powered by dual propulsion units and constructed in accordance with a first embodiment of the invention.
Figure 2:
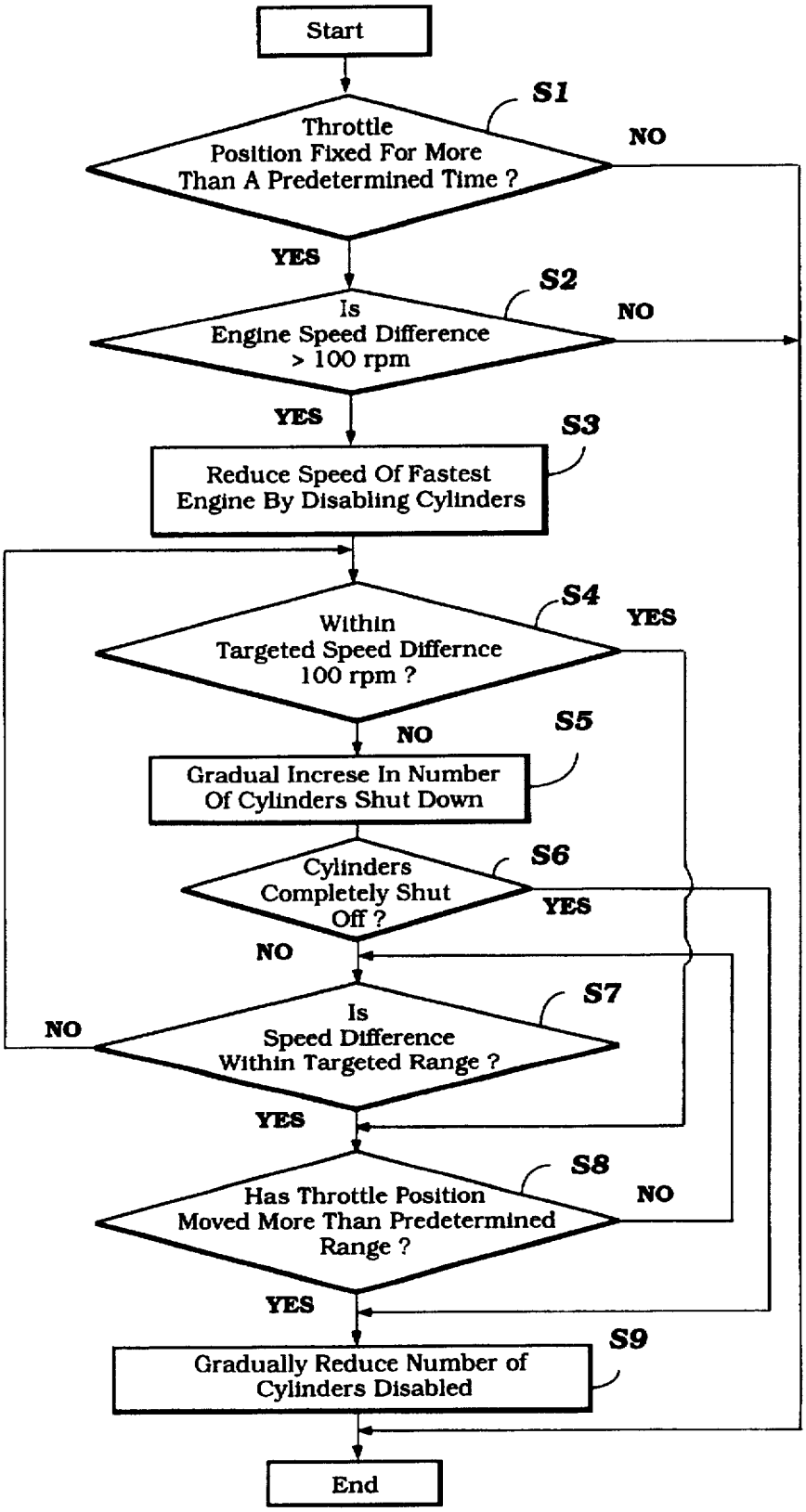
FIG. 2 is a block diagram showing the control routine for the embodiment of FIG. 1.

Referring now in detail to the first embodiment of the invention shown in FIGS. 1 and 2 and initially primarily to FIG. 1, a watercraft constructed in accordance with this embodiment of the invention is identified generally by the reference numeral 11. The watercraft 11 is comprised of a hull 12 which may be of any known configuration and on which a pair of marine propulsion devices in the form of outboard motors 13 and 14 are mounted.

The basic construction of the hull 12 and outboard motors 13 and 14 may be of any type known in the art. Since the invention deals primarily with the control system for the outboard motors 13 and 14 rather than their specific construction, little in the way of details of the construction is illustrated. However, certain components are illustrated schematically so as to permit those skilled in the art to understand the operation and construction of the invention. Where any detail is not shown, it may be considered to be conventional.

Each outboard motor 13 and 14 is provided with a powering internal combustion engine which includes an engine speed control, in the illustrated embodiment that being a throttle valve assembly 15 and 16, respectively. The throttle valve assemblies 15 and 16 control the speed of the engines of the outboard motors 13 and 14 in a well known manner.

In order to facilitate and simplify the construction, a single throttle control level 17 is mounted in the hull 12 in an appropriate position proximate to the operator's position. The single throttle control 17 is connected by respective bowden wire actuators 18 and 19 to the respective throttle valve assemblies 15 and 16 for effecting their operation.

In accordance with the control methodology for the operation of the engines of the outboard motors 13 and 14, each outboard motor is provided with a respective throttle valve position sensor 21 and 22. These sensors 21 and 22 output their position signals to respective control units 23 and 24 of the outboard motors 13 and 14, respectively.

The control units 23 and 24 may, in addition to the function to be described, provide various other control strategies for various components of the engines. For example, the position of the respective throttle valves 15 and 16 may be employed in the fuel control circuits for the respective outboard motors 13 and 14. Other utilization of the throttle position sensors 21 and 22 and the controls 23 and 24 will be obvious to those skilled in the art.

In accordance with the invention, however, each of the throttle position sensors 21 and 22 is adapted to provide a signal which is indicative of the position of the throttle valves 15 and 16 and the respective control 23 and 24 may compare those positions with the position of the single lever throttle control 17 so as to provide a comparison in the actual position with respect to the desired position. If there is a misalignment in the positions, then the device can function so as to reduce the speed of both engines since the throttle valve of one engine is obviously not responding to the single lever control 17.

However, the system can operate in a different manner and one which will now be described. In accordance with this manner, the outputs of the controls 23 and 24 are linked together by a communicating section 25 in which a logic section 26 is provided so as to provide the communication and the logic which will now be described by reference to FIG. 2, whereby malfunctions are determined and corrected for.

The program starts and then goes to the step S1 wherein a timer is run to determine if the position of the respective throttle valves 15 and 16 has been constant for more than a predetermined time period. This is done so as to ensure that the system and particularly the speed of the engines has had time to stabilize once the throttle valves 15 and 16 have had their positions changed by the single lever control 17. If the throttle valve position has not been fixed for more than a predetermined time period set by the timer, the program merely repeats.

If, however, the position of the throttle valves 15 and/or 16 has been fixed for more than the predetermined time period, which is a relatively short time period, the program moves to the step S2. In the step S2, speed control signals received by the individual controls 23 and 24 by appropriate sensors in their engines are compared in the communication circuit and logic circuit 26. If the speed of the engines differs by less than 100 rpm, this is considered a normal and the program then repeats.

If, however, it is determined that the speed of the engines associated with the motors 13 and 14 differ from each other by more than 100 rpm, the program moves to the step S3. At the step S3, the speed of the engine of the engine of the outboard motor 13 and 14 which is the highest is reduced by any known manner. In a preferred form, the speed of the engine of the faster of the two outboard motors is reduced by misfiring the spark plugs of certain cylinders of the engine or otherwise disabling combustion in those certain cylinders. This is a well known expedient for engine speed reduction and any of those systems known in the art may be employed.

After the disabling of the firing of certain cylinders is initiated at the step S3, the program moves to the step S4 to determine if the speed difference between the engines of the outboard motors 13 and 14 has fallen to 100 rpm or less. If it has, the program skips ahead to the step S8. If not, however, the program moves to the step S5.

At the step S3, the engine speed is reduced initially by primarily misfiring a relatively small number of cylinders of the engine. The number misfired will depend upon the total number of cylinders in the engine. In addition, the cylinders need not be totally disabled but may be disabled for example for every other or every third cycle.

If, however, the initial speed reduction method has not been successful in providing the desired speed reduction or minimization of the speed difference, the program at the step S5 gradually increases the number of cylinders shut down or the frequency of the shut down.

The program then moves to the step S6 to determine if the cylinders of the higher speed engine have been completely shut down. If they are, the program jumps to the step S9. If not, however, the program then moves to the step S7.

At the step S7, the program moves to determine again if the speed difference is within the targeted range, i.e., 100 rpm. If it is not, the program repeats back to the step S4 so as to continue to increase the number and time of cylinder disablement.

If, however, at the step S8 it is, determined that the speed difference between the engines of the outboard motors 13 and 14 is less than 100 rpm, then the program moves to the step S8. At the step S8 it is determined if there has been movement of either or both of the throttle valves 15 or 16. Alternatively, a sensor may be provided at the single lever throttle control 17 to determine if its position has been changed.

If at the step S8 it is determined that the throttle position has not changed, the program repeats back to the step S7 and continues to monitor whether the speed difference is within the targeted range and if not makes further corrections.

If, however, at the step S8 it is determined that the throttle position has changed, then the program moves to the step S9. At the step S9, the engine of the outboard motor 13 or 14 which has had its cylinders disabled is not immediately restored to full operation. Rather, the number of cylinders disabled is gradually reduced and the program then repeats.

Therefore, it should be readily apparent that this embodiment provides an arrangement wherein the abnormality in the engine speeds is corrected without making abrupt changes and when the correction appears to have been successful, the engine running is not immediately returned to normal but is done gradually.

Figure 3:
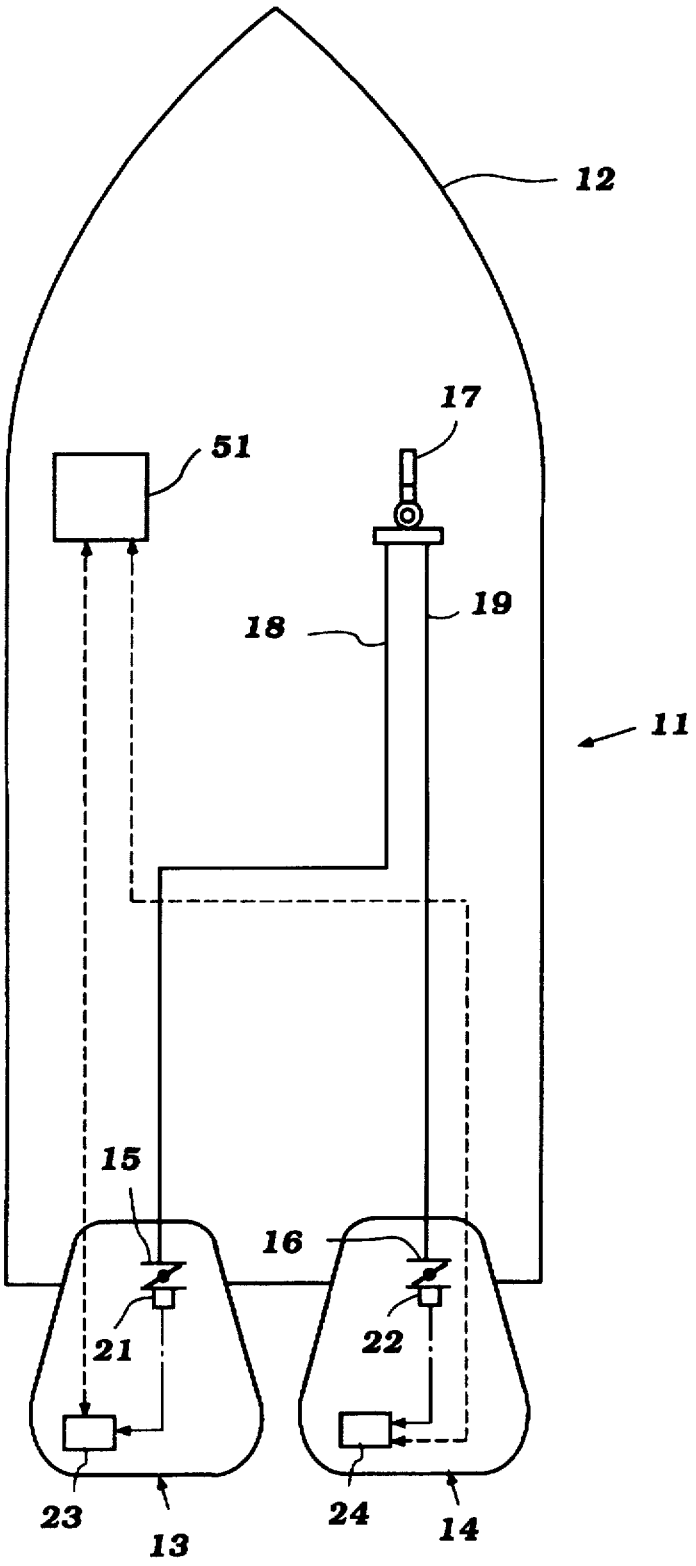
FIG. 3 is a partially schematic top plan view, in part similar to FIG. 1, and shows another embodiment of the invention.

In addition to utilizing the control in response to throttle valve condition, the control may also function to provide protection for other abnormal conditions. One way this may be done is shown in FIG. 3 and it should be understood that the construction shown in FIG. 3 may be utilized either in combination with the control routine already described or may be utilized alone.

In this embodiment, the communication conduit 25 and controller 26 can be replaced and each individual control 23 and 24 for the respective engines of the outboard motors 13 and 14 is interconnected to a single controller 51 which may be conveniently mounted in the hull 12 of the watercraft 11. The controller 51 may provide the speed controlling arrangement as aforedescribed when the speed of the engines differs by more than 100 rpm.

In addition, each outboard motor 23 and 24 has a segment that receives signals from certain engine conditions which would indicate abnormal engine conditions. These signals may include engine temperature signals that indicate an overheating condition, engine water inlet signals which may indicate a reduction or obstruction in the water inlet to the cooling system, lubrication warning sensors which may indicate a low lubricant pressure or low lubricant level in the storage systems for the engines or other abnormal engine conditions. In the event such an abnormal engine condition is sensed in either outboard motor 13, this condition is signaled to the controller 51 and the controller 51 initiates a protective mode whereby the speed of both outboard motors 13 and 14 is decreased.

Thus, unlike prior art constructions where the speed of one engine is decreased and then the speed reduction signal is transmitted to the other engine and its speed is reduced by its own control, a single control serves those functions. Therefore, this provides a simplification and cost reduction with the same or better results.

From the foregoing description it should be readily apparent to those skilled in the art that the described embodiment of the invention is very effective in providing good engine control. It should be apparent to those skilled in the art that the foregoing description, however, is that of preferred embodiments of the invention and that various changes and modifications may be made without departing from the spirit and scope of the invention, as defined by the appended claims.

What is claimed is:

1. A marine propulsion control system for a watercraft having a hull, a pair of propulsion units carried by said hull for propelling said watercraft, each of said propulsion units having a function control for controlling a specific function of the respective propulsion unit, a single moveable control element positioned within said hull, means for mechanically coupling said single moveable control element to each of said function controls for controlling the same function of each of said propulsion units, sensing means for sensing when the condition of the respective functions of the propulsion units being controlled do not correspond with each other, and means for altering the condition of one of the propulsion units to coincide with each other, and means for altering the condition of one of the propulsion units to coincide with that condition of the other propulsion unit.

2. A marine propulsion control system as set forth in claim 1, wherein the condition comprises the speed of the propulsion unit and wherein the speed of the faster propulsion unit is reduced.

3. A marine propulsion control system as set forth in claim 2, wherein the element of the propulsion unit controlled is the speed control.

4. A marine propulsion control system as set forth in claim 3, wherein a single control unit controls the speed of both of the engines in the event of an abnormal condition.

5. A marine propulsion control system as set forth in claim 1, further including an abnormal condition sensor for each of the propulsion units for sensing an abnormal condition of the respective propulsion unit and means for reducing the speed of both of the propulsion units in the event an abnormal condition of one of the propulsion units is sensed.

6. A marine propulsion control system as set forth in claim 5, wherein a common control controls the speed of both of the propulsion units in response to the signals from the abnormal condition indicators.

7. A marine propulsion control system as set forth in claim 6, wherein the abnormal condition sensed is an abnormal running condition of an internal combustion engine of each of the propulsion units.

8. A marine propulsion control system as set forth in claim 7, wherein the abnormal condition comprises at least one of engine temperature, cooling water inlet, and lubricant condition.

9. An abnormal condition control system for a watercraft as set forth in claim 1 further including an abnormal condition sensor for each of said propulsion units for sensing an abnormal condition thereof, and the means for altering includes a single control unit for receiving output signals from said abnormal condition sensors and for controlling the operation of both of said propulsion units in the event of the sensing of an abnormal condition of either of the propulsion units.

10. An abnormal condition control system for a watercraft as set forth in claim 9, wherein the propulsion unit operation controlled comprises the speed of the propulsion unit and wherein the speed of the faster propulsion unit is reduced.

11. An abnormal condition control system for a watercraft as set forth in claim 10, wherein the abnormal condition sensed is an abnormal running condition of an internal combustion engine of each of the propulsion units.

12. An abnormal condition control system for a watercraft as set forth in claim 11, wherein the abnormal condition comprises at least one of engine temperature, cooling water inlet, and lubricant condition.

* * * * *